US012644615B2

(12) United States Patent
Lin et al.

(10) Patent No.: US 12,644,615 B2
(45) **Date of Patent: *Jun. 2, 2026**

(54) AIRFLOW APPARATUS

(71) Applicant: LEEDARSON LIGHTING CO., LTD., Zhangzhou (CN)

(72) Inventors: Pingqiu Lin, Zhangzhou (CN); Kunbin Li, Zhangzhou (CN); Shiwei Li, Zhangzhou (CN); Qiubo Shi, Zhangzhou (CN); Linfeng Yang, Zhangzhou (CN)

(73) Assignee: LEEDARSON LIGHTING CO., LTD., Zhangzhou (CN)

( * ) Notice: Subject to any disclaimer, the term of this patent is extended or adjusted under 35 U.S.C. 154(b) by 279 days.

This patent is subject to a terminal disclaimer.

(21) Appl. No.: 18/227,647

(22) Filed: Jul. 28, 2023

(65) Prior Publication Data

US 2024/0035685 A1 Feb. 1, 2024

(30) Foreign Application Priority Data

Jul. 28, 2022 (CN) ..... 202210901384.9

(51) Int. Cl.

| | |
|---|---|
| ***F24F 7/06*** | (2006.01) |
| ***F24F 8/22*** | (2021.01) |
| ***F24F 13/02*** | (2006.01) |

(52) U.S. Cl.

CPC ..... *F24F 7/065* (2013.01); *F24F 8/22* (2021.01); *F24F 13/0254* (2013.01); *F24F 2221/02* (2013.01)

(58) Field of Classification Search

CPC ..... F24F 7/065; F24F 8/22; F24F 13/0254; F24F 2221/02

See application file for complete search history.

(56) References Cited

U.S. PATENT DOCUMENTS

2024/0410394 A1* 12/2024 Li ..... F04D 29/4226

* cited by examiner

*Primary Examiner* — Nicole M Ippolito
(74) *Attorney, Agent, or Firm* — LANWAY IPR SERVICES; Chun-Ming Shih

(57) ABSTRACT

An airflow apparatus includes an air tunnel, a fan motor, a fan blade, a box housing and two expandable side units. The fan blade is driven by the fan motor for moving air moving in the air tunnel. The box housing encloses the fan motor, the fan motor and the fan blade. The box housing has multiple fixing units for fixing to a bracket when the box housing is place upon the bracket for limiting movement of the box housing in a first installation mode. The two expandable side units are attached to a lateral side of the box housing. The expandable side units have extending portions extending respectively from two opposite peripheral edges of the box housing. There is an ear hole for each expandable side unit for inserting a fixing hook placed on an installation wall surface in a second installation mode.

20 Claims, 17 Drawing Sheets

AIRFLOW APPARATUS

FIELD

The present invention is related to an air flow apparatus, and more particularly related to an air flow apparatus with a flexible structure.

BACKGROUND

The function of a fan device installed on a ceiling is to circulate and move air within a room or an enclosed space. Ceiling fans are designed to improve the airflow, creating a cooling effect during hot weather and providing additional comfort to occupants.

When the fan rotates, it creates a breeze that helps evaporate moisture from the skin, which can make people feel cooler even without lowering the room temperature. This "wind chill" effect can make a room feel several degrees cooler, allowing occupants to set their air conditioning systems at higher temperatures and potentially save energy.

In addition to cooling, some ceiling fans are designed with a reversible motor, allowing them to operate in both forward and reverse directions. In the forward direction, the fan creates a downdraft that helps cool the room. In the reverse direction, the fan creates an updraft, which helps distribute warm air trapped near the ceiling during colder months, improving the efficiency of heating systems.

Ceiling fans play a vital role in improving indoor comfort by promoting better air circulation within a room or enclosed space. These modular fan devices, installed in the cavity of a ceiling, are equipped with fan blades or impellers that rotate when activated. As the blades spin, they draw in the surrounding air and propel it downwards, creating a vertical airflow that moves throughout the room. This downward movement of air creates a gentle breeze that induces a "wind chill" effect, making occupants feel cooler even without lowering the room temperature significantly.

Moreover, the ceiling fan's function extends beyond just cooling. By moving air downwards, the fan also helps in mixing the air within the room. It pushes the air along the walls and floor, resulting in more even distribution throughout the space. This action reduces the occurrence of hot and cold spots, ensuring a more consistent and comfortable environment for occupants.

The circulation of air provided by ceiling fans can complement existing air conditioning and heating systems. During hot weather, the cooling effect of the fan enables occupants to raise the thermostat setting on the air conditioner, potentially leading to energy savings. Similarly, during colder weather, reversing the fan's direction helps distribute warm air trapped near the ceiling, improving the efficiency of heating systems and enhancing overall comfort.

Another advantage of ceiling fans is their ability to support ventilation in spaces with limited airflow. By promoting air movement, they help reduce stuffiness and assist in removing odors or smoke by directing them towards exhaust vents.

Proper air flow in an indoor environment is of utmost importance for maintaining human health and well-being. When indoor air becomes stagnant and lacks circulation, it can lead to a range of health issues and discomfort for occupants. Therefore, installing an airflow device, such as a ceiling fan, is a beneficial measure to ensure a well-ventilated and comfortable indoor space.

One of the key reasons why good air flow is essential is its role in providing an adequate supply of fresh oxygen. Humans require a steady flow of oxygen for respiration and cellular function. Stagnant air can lead to a depletion of oxygen levels, resulting in feelings of fatigue, dizziness, and impaired cognitive function.

Moreover, proper air circulation helps remove stale and stagnant air from the room. Stale air can contain accumulated pollutants, allergens, and unpleasant odors, leading to indoor air pollution. By promoting the exchange of fresh air, an airflow device reduces the concentration of harmful particles and helps maintain a healthier indoor environment.

Controlling humidity levels is another critical aspect of air flow. Effective ventilation helps regulate humidity, preventing the growth of mold and mildew, which thrive in damp conditions. Excessive moisture in the air can also cause condensation on windows and walls, leading to potential damage to building materials and an increased risk of health issues.

Temperature regulation is a significant benefit of well-distributed air flow. In warmer climates, a properly functioning airflow device, such as a ceiling fan, helps circulate cool air throughout the room, creating a more comfortable living or working environment. Similarly, in colder seasons, reversing the fan's direction helps distribute warm air trapped near the ceiling, providing a more even and comfortable indoor temperature.

Beyond physical health, indoor air quality significantly impacts mental focus and productivity. Fresh air and proper ventilation are associated with improved cognitive function, concentration, and overall work performance. In contrast, poor indoor air quality can lead to feelings of fatigue, irritability, and reduced productivity.

For individuals with respiratory conditions such as asthma and allergies, a well-ventilated space is particularly important. Air circulation helps disperse airborne irritants, reducing the concentration of allergens and pollutants, and thereby minimizing asthma attacks and allergy symptoms.

In conclusion, the installation of an airflow device, like a ceiling fan, plays a crucial role in promoting human health and comfort in indoor environments. By facilitating the exchange of fresh air, controlling humidity levels, removing contaminants, and supporting temperature regulation, a well-designed airflow system contributes to a healthier, more comfortable, and productive living or working space. The positive impact on respiratory health, mental focus, and overall indoor air quality underscores the significance of installing an airflow device to enhance the well-being of occupants.

Incorporating ceiling fans into indoor spaces enhances energy efficiency by reducing the reliance on air conditioning and heating alone. With their cooling and air-circulating abilities, ceiling fans provide occupants with a comfortable environment while potentially reducing overall energy consumption.

It is beneficial if a modular fan device with a compact size may be designed and easy to be installed.

SUMMARY

In some embodiments, a airflow apparatus includes an air tunnel, a fan motor, a fan blade, a box housing and two expandable side units.

The fan blade is driven by the fan motor for moving air moving in the air tunnel.

The box housing encloses the fan motor, the fan motor and the fan blade.

The box housing has multiple fixing units for fixing to a bracket when the box housing is place upon the bracket for limiting movement of the box housing in a first installation mode.

The two expandable side units are attached to a lateral side of the box housing.

The expandable side units have extending portions extending respectively from two opposite peripheral edges of the box housing.

There is an ear hole for each expandable side unit for inserting a fixing hook placed on an installation wall surface in a second installation mode.

In some embodiments, the expandable side unit includes a geometry plate.

The ear hole is disposed on the geometry plate.

In some embodiments, the expandable side unit is detached from the box housing in the first installation mode.

In some embodiments, the expandable side unit is pushed and retracted in a storage area of the box housing in the first installation mode.

The expandable side unit is pulled to extend in the second installation mode.

In some embodiments, the expandable side unit is rotated to extend in the second installation mode.

The expandable side unit is rotated to be retracted in a storage area of the box housing in the first installation mode.

In some embodiments, the expandable side unit is fixed to the box housing with a rotation axle.

In some embodiments, the bracket has two extendable tracks.

The extendable track has a track slit.

The fixing unit passes through the track slit and bent to limit movement of the box housing with respect to the bracket.

In some embodiments, the track slit is an elongated slit with two opposite ends.

The fixing unit is fixed within the range of the elongated slit.

In some embodiments, the fixing unit has an elastic hook to pass through the elongated slit and fasten the fixing unit to the expandable track.

In some embodiments, the fixing unit has a bending part.

The bending part is bent after passing through the track slit to fasten the fixing unit to the extendable track.

In some embodiments, the bending part has a first bending portion and a second bending portion.

The first bending portion and the second bending portion are bent in opposite directions.

In some embodiments, the airflow apparatus may also include the bracket.

The expandable track has a track part and a bar part, where the bar part is retracted partly in the track part to change a length of the expandable track.

In some embodiments, the track parts of the two extendable tracks are connected to opposite sides of the bracket.

In some embodiments, a first air vent of the box housing faces downwardly to the bracket.

In some embodiments, a second air vent of the box housing is disposed to another lateral side.

The air tunnel connects the first air vent to the second air vent.

In some embodiments, the airflow apparatus may also include an ultraviolet light source for sterilization.

The ultraviolet light source is placed in the air tunnel and concealed by the box housing.

In some embodiments, the airflow apparatus may also include a illumination light source.

The illumination light source emit light escaping from the first air vent.

In some embodiments, the box housing has a light bracket for attaching the illumination light source.

The first air vent is a gap aside the light bracket.

In some embodiments, the illumination light source is detachable from the light bracket.

In some embodiments, the bracket further has two side bars for connecting the two extendable tracks forming a rectangular shape.

The two side bars are fixed on two opposite walls.

DETAILED DESCRIPTION

Figure 13A:
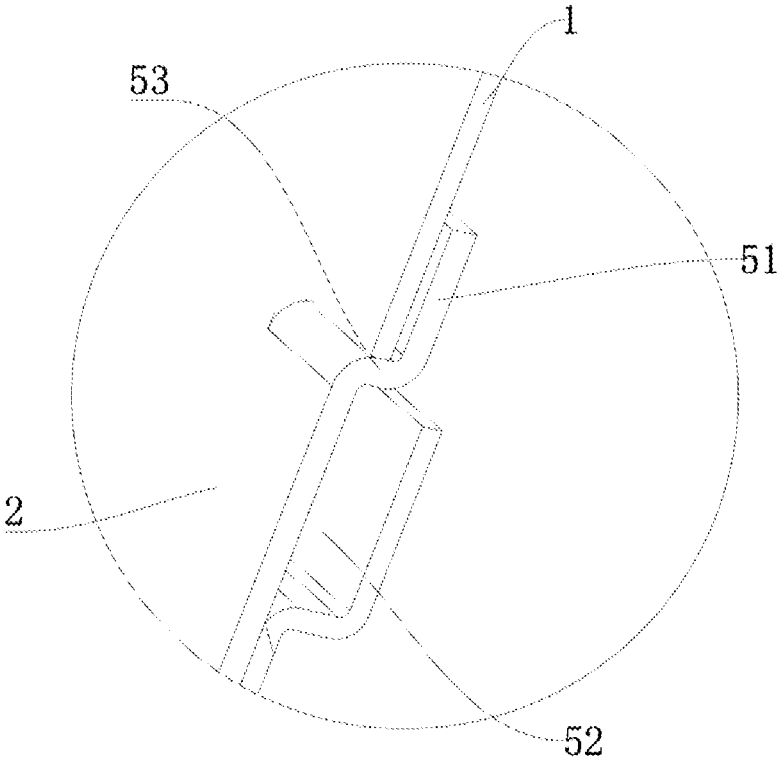
FIG. 13A illustrates a zoom-up view showing connection example.
Figure 13B:
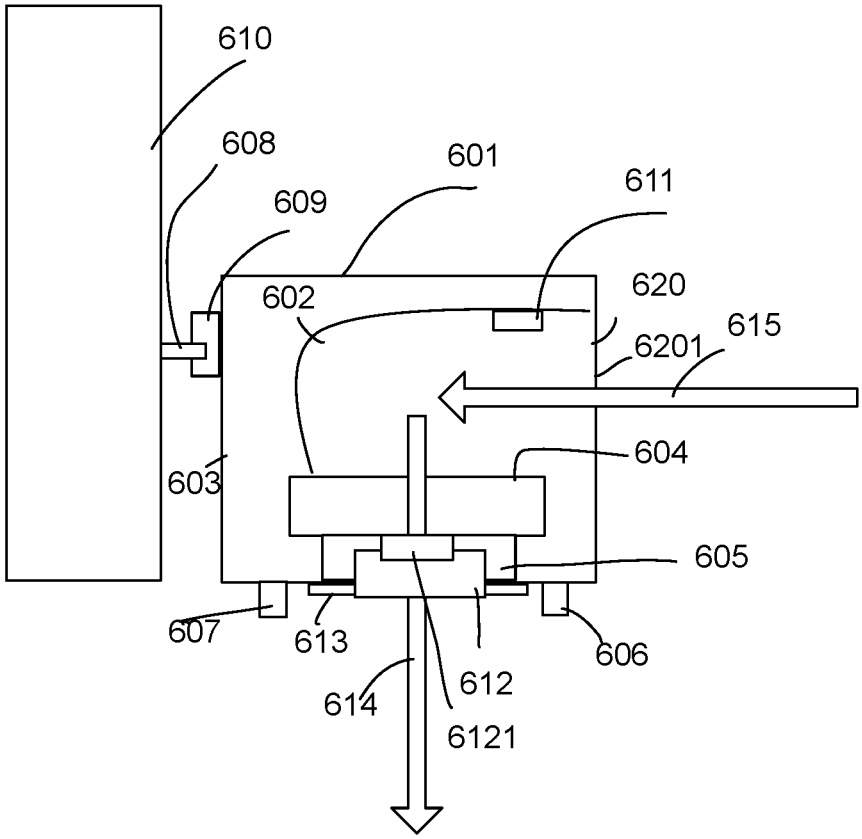
FIG. 13B shows another example.

In FIG. 13B, an airflow apparatus includes an air tunnel 602, a fan motor 604, a fan blade 605, a box housing 601 and two expandable side units 609.

FIG. 13B is a side view and thus, an expandable side unit 609 is visible. Another expandable side unit is attached on the same lateral side 603 of the box housing 601.

Figure 3:
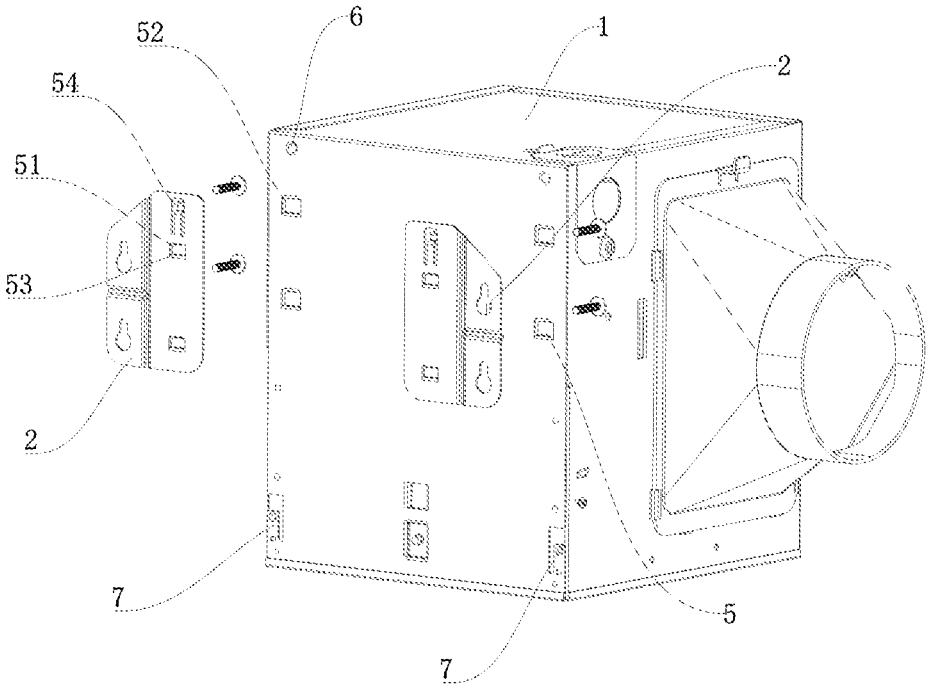
FIG. 3 illustrates two detachable expandable side units to be attached to a box housing.

FIG. 3 shows an exploded view of an example. In FIG. 3, there are two expandable side units 2 to be selectively attached to the box housing 1.

The fan blade 605 is driven by the fan motor 604 for moving air moving in the air tunnel 602.

There is a first air vent 613 and a second air vent 620. Air may flow from first air vent 613 to the second air vent 620. In some other embodiments, the air is flowing from the second air vent 620 to the first air vent 613.

Various fan blade designs and associated driving motors are used in different types of fans to meet specific airflow requirements and aesthetic preferences.

Standard Fan Blades with AC Motors: Traditional ceiling fans and box fans often use standard fan blades that have a slightly curved shape to efficiently move air. These fans are commonly powered by AC (alternating current) motors, which are cost-effective and reliable for continuous use. AC motors provide a steady rotation to the fan blades, creating a constant and consistent airflow.

Bladeless Fans with DC Motors: Bladeless fans, also known as air multipliers, are innovative designs that use a hidden impeller to draw in air and then expel it through a narrow slot. These fans provide a smooth and uninterrupted airflow without visible blades. Bladeless fans often employ DC (direct current) motors, which are more energy-efficient than AC motors. DC motors offer variable speed control, allowing users to adjust the airflow intensity as needed.

Propeller-Like Blades with High-Velocity Motors: High-velocity fans are commonly used in commercial and industrial settings where powerful airflow is required. These fans feature propeller-like blades that resemble airplane propellers. They are driven by high-velocity motors that generate powerful gusts of air, making them ideal for cooling large spaces or removing heat from industrial areas.

Sculptural Fan Blades with DC Motors: Some modern ceiling fans come with sculptural or artistic fan blades that serve both functional and decorative purposes. These fans often utilize DC motors for energy efficiency and smooth operation. The unique designs of the fan blades can enhance the aesthetics of the room while providing efficient air circulation.

Blades with Adjustable Angles and Motors with Remote Controls: Certain fan models, particularly ceiling fans, are equipped with blades that have adjustable angles. These fans allow users to change the angle of the blades to control the direction and intensity of the airflow. They often come with motors featuring remote control functionality, enabling users to conveniently adjust the fan speed and blade angle from a distance.

Retractable Fan Blades with Reversible Motors: Some contemporary ceiling fans are designed with retractable blades that remain concealed when the fan is not in use. When activated, the fan blades extend and rotate to circulate air. These fans often feature reversible motors, allowing them to function in both summer and winter modes. In summer mode, the fan creates a cooling breeze, while in winter mode, it distributes warm air trapped near the ceiling.

The box housing 601 encloses the air tunnel 602, the fan motor 604 and the fan blade 605.

The box housing 601 has multiple fixing units 606, 607 for fixing to a bracket when the box housing 601 is place upon the bracket for limiting movement of the box housing in a first installation mode.

Figure 2:
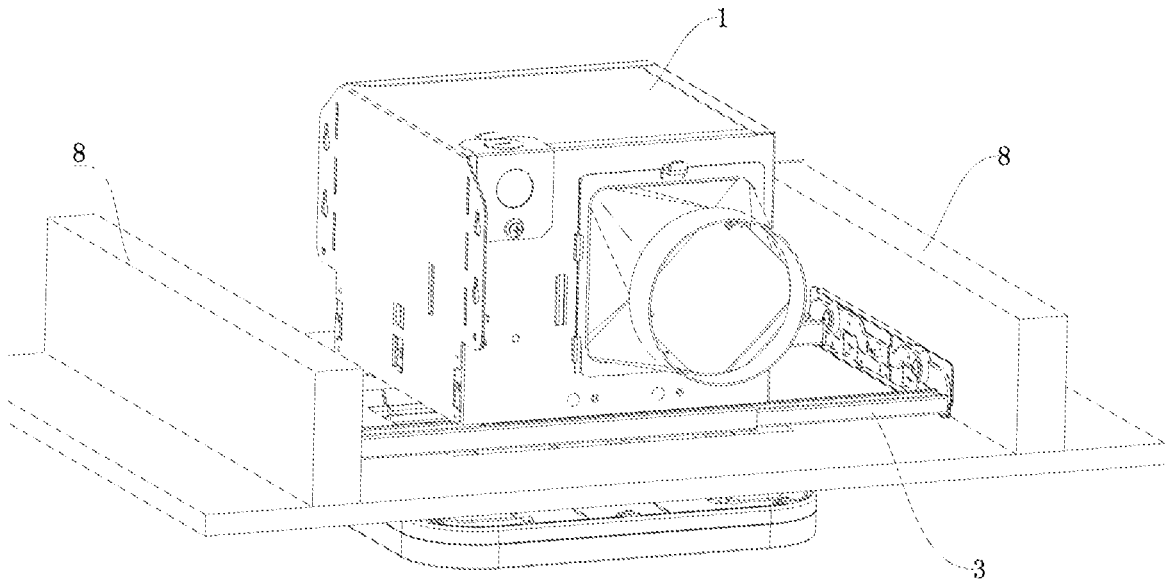
FIG. 2 illustrates the airflow apparatus installed in a second installation mode.

FIG. 2 shows an example of a first installation mode. In FIG. 2, the box housing 1 is placed upon a bracket 3.

The two expandable side units 609 are attached to a lateral side 603 of the box housing 1.

The expandable side units 609 have extending portions extending respectively from two opposite peripheral edges of the box housing 1.

Figure 10:
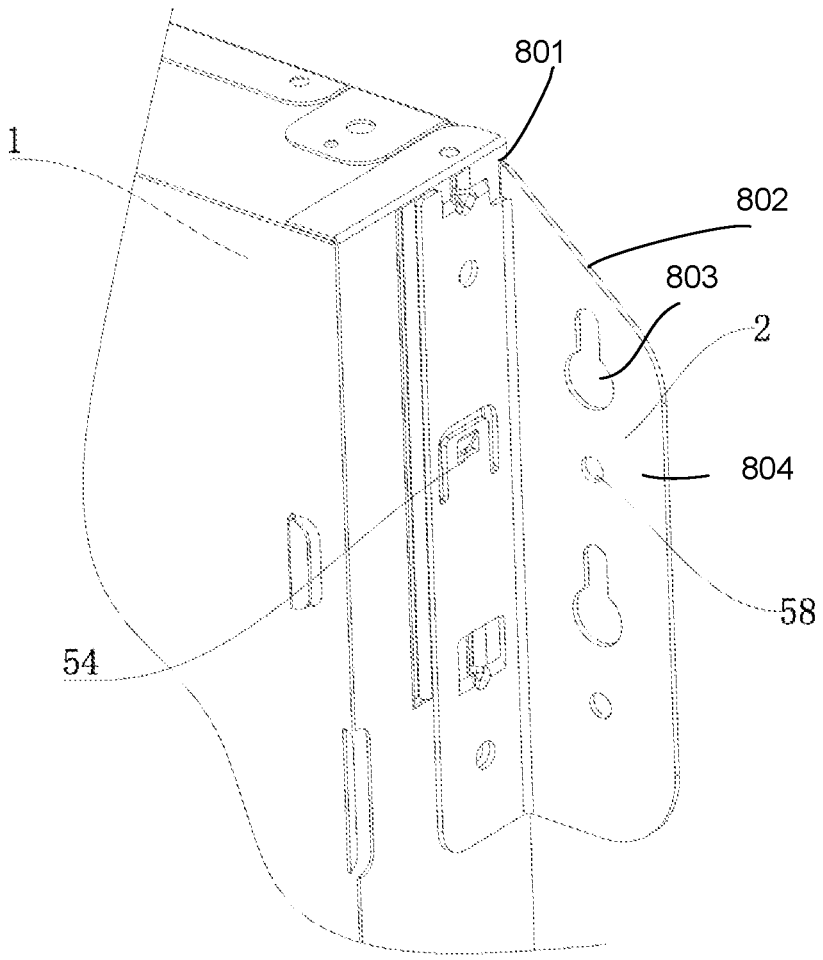
FIG. 10 illustrates connector structure examples.

In the example of FIG. 10, an expandable side unit 2 has an extending portion 802 extending from a peripheral edge 801 of the box housing 1. The other expandable side unit extends from an opposite peripheral edge of the box housing 1 symmetrically (not shown).

There is an ear hole 803 for each expandable side unit 2 for inserting a fixing hook placed on an installation wall surface in a second installation mode.

FIG. 13B shows an example that the expandable side unit 609 is attached to a fixing hook 608 with its ear hole, as illustrated in FIG. 10 and explained above.

In some embodiments, the expandable side unit includes a geometry plate.

FIG. 10 shows an example of such geometry plate 804, which can be a rectangular shape, a triangle shape, or any other geometric shape.

The ear hole 803 is disposed on the geometry plate 804.

In some embodiments, the expandable side unit is detached from the box housing in the first installation mode.

For example, the expandable side unit is detached from the box housing and removed when the box housing is to be installed in the second installation mode.

Figure 16A:
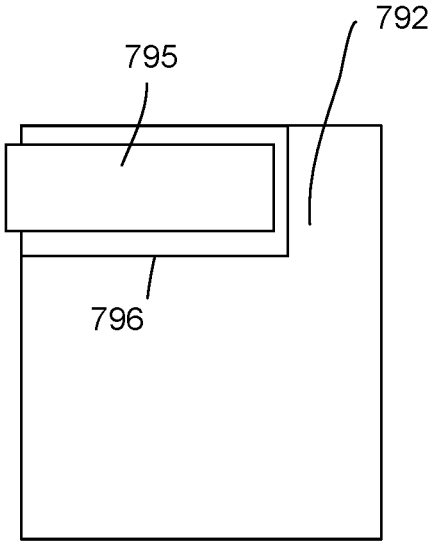
FIG. 16A and FIG. 16B show another expandable side unit operation example.
Figure 16B:
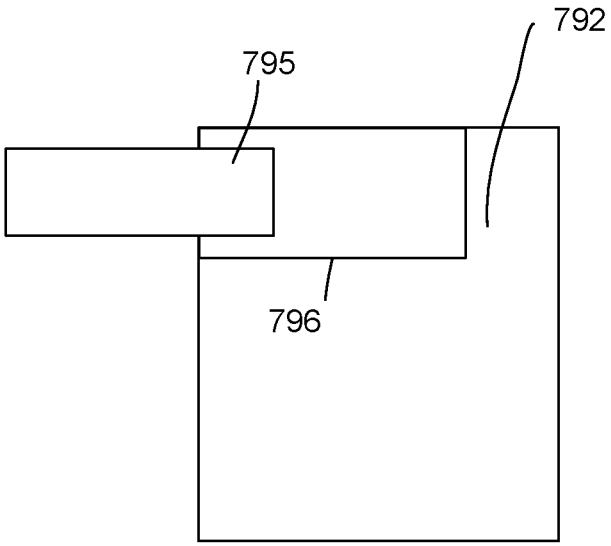

In FIG. 16A and FIG. 16B, the expandable side unit 795 is pushed and retracted in a storage area 796 of the box housing 792 in the first installation mode.

The expandable side unit 795 is pulled to extend by leaving from the storage area 796 in the second installation mode.

Figure 15A:
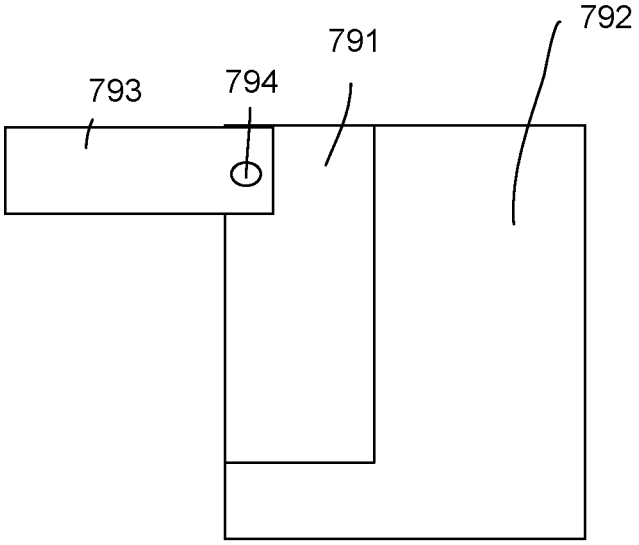
FIG. 15A and FIG. 15B show an expandable side unit operation example.
Figure 15B:
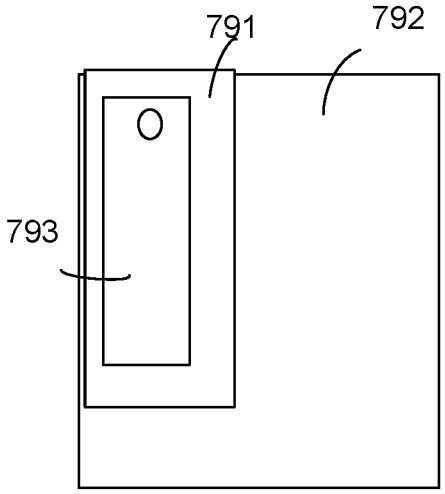

In FIG. 15A and FIG. 15B, the expandable side unit 793 is rotated to extend in the second installation mode.

The expandable side unit 793 is rotated to be retracted in a storage area 791 of the box housing 792 in the first installation mode.

In FIG. 15A, the expandable side unit 793 is fixed to the box housing 792 with a rotation axle 794.

Figure 14A:
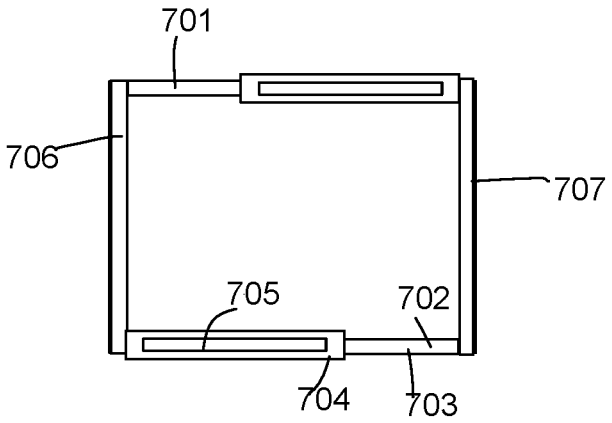
FIG. 14A and FIG. 14B show an extendible frame example.

In FIG. 14A and FIG. B, the bracket has two extendable tracks 701, 703.

The extendable track 701 has a track slit 705.

The fixing unit passes through the track slit and bent to limit movement of the box housing with respect to the bracket. Please also refer to the example of FIG. 13B explained above.

Figure 14B:
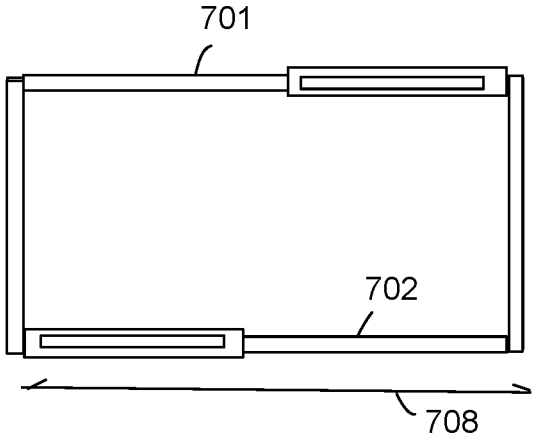

In some embodiments, the track slit is an elongated slit with two opposite ends, as illustrated in FIG. 14A and FIG. 14B.

The fixing unit is fixed within the range of the elongated slit.

In some embodiments, the fixing unit has an elastic hook to pass through the elongated slit and fasten the fixing unit to the expandable track.

Figure 5:
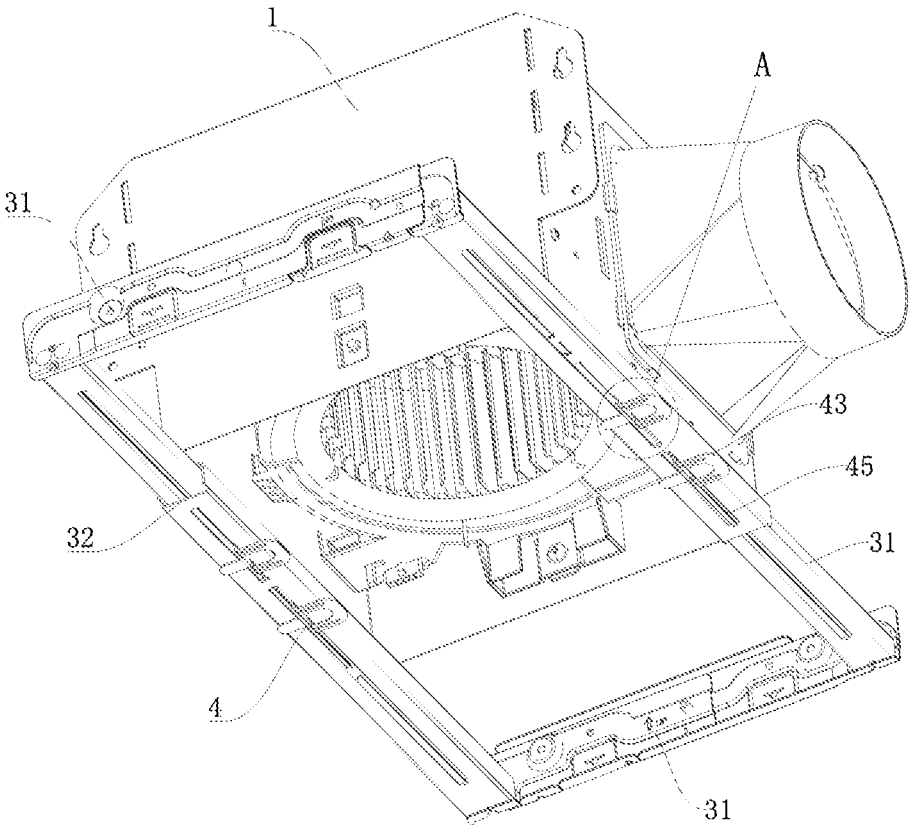
FIG. 5 illustrates a bottom perspective view of an airflow apparatus embodiment.

FIG. 5 shows an elastic hook 42 passing through the elongated slit to fasten the box housing to the bracket.

In some embodiments, the fixing unit has a bending part.

The bending part is bent after passing through the track slit to fasten the fixing unit to the extendable track.

In some embodiments, the bending part has a first bending portion and a second bending portion.

Figure 6:
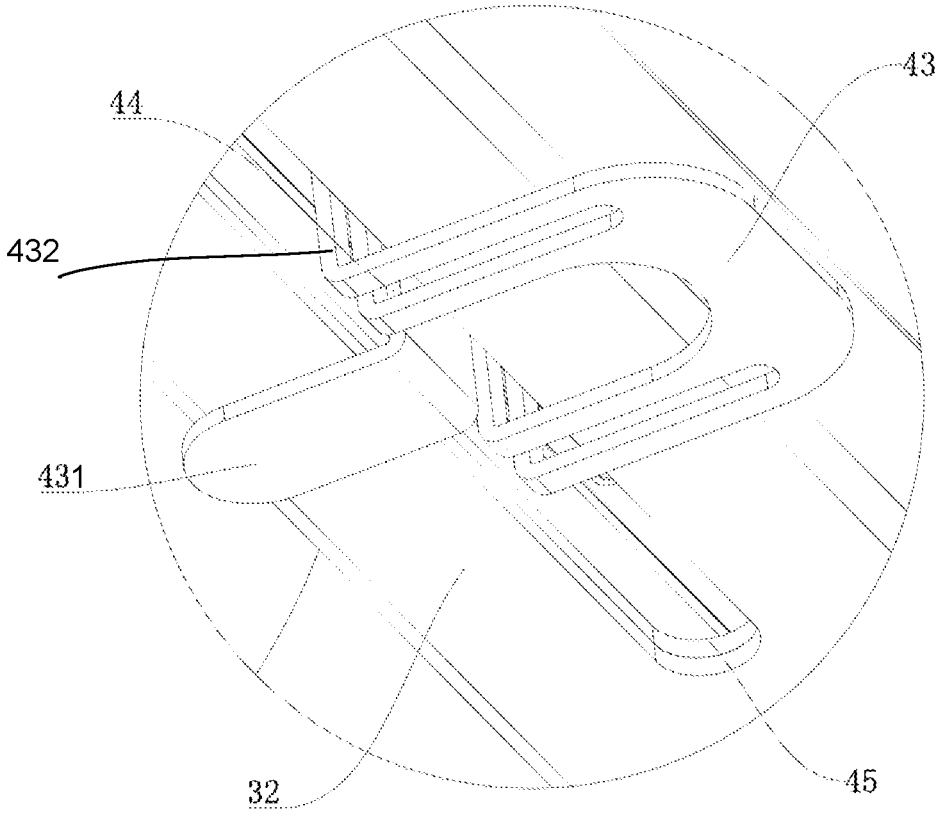
FIG. 6 illustrates a zoom-up view of a fixing unit.

FIG. 6 shows an example of such bending part 432 that includes a first bending portion 43 and a second bending portion 431

The first bending portion 43 and the second bending portion 431 are bent in opposite directions.

In FIG. 14A and FIG. 14B, the airflow apparatus may also include the bracket.

The expandable track has a track part 705 and a bar part 703, where the bar part 703 is retracted partly in the track part 705 to change a length 708 of the expandable track 702.

In FIG. 14A and FIG. 14B, the track parts 705 of the two extendable tracks are connected to opposite sides of the bracket.

Specifically, the track parts are arranged in a symmetric way as illustrated in FIG. 14A and FIG. 14B, which is found lowering possible noise and shaking.

In FIG. 13B, a first air vent 613 of the box housing 1 faces downwardly to the bracket.

In FIG. 13B, a second air vent 620 of the box housing 1 is disposed to another lateral side 6201.

The air tunnel connects the first air vent to the second air vent.

In FIG. 13B, the airflow apparatus may also include an ultraviolet light source 611 for sterilization.

The ultraviolet light source 611 is placed in the air tunnel and concealed by the box housing 1.

In some embodiments, the airflow apparatus may also include a illumination light source 6121.

The illumination light source 6121 emit light escaping from the first air vent 613.

In some embodiments, the box housing has a light bracket 612 for attaching the illumination light source 6121.

The first air vent 613 is a gap aside the light bracket 612.

In some embodiments, the illumination light source 612 is detachable from the light bracket 6121.

In FIG. 14A, the bracket further has two side bars 706, 707 for connecting the two extendable tracks 701, 702 forming a rectangular shape.

The two side bars 706, 707 are fixed on two opposite walls.

FIG. 1 to FIG. 12 show several examples of airflow apparatus embodiments. Same references refer to same components and may not be explained again for every drawing for brevity.

Figure 1:
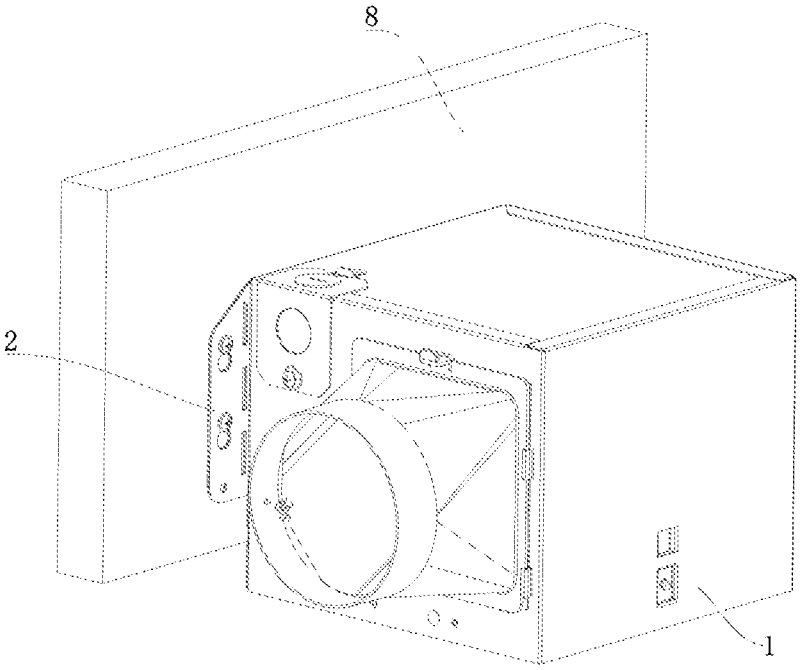
FIG. 1 illustrates an airflow apparatus embodiment.

In FIG. 1, a box housing 1 is used for containing a fan device. There is an expandable side unit 2 for fixing the box housing 1 to a wall 8.

In FIG. 2, it shows that the box housing 1 is attached to a different installation wall 8 with a bracket 3.

FIG. 3 shows two expandable side units 2 detachable from a box housing 1.

The expandable side unit 2 has an installation plate 51, an installation hole 53, an elastic protruding part 53, and another installation hole 52 on the box housing 1.

There is a positioning cavity 6 for attaching the expandable side unit 2.

There is a bending card 7 and a detaching structure 5.

Figure 4:
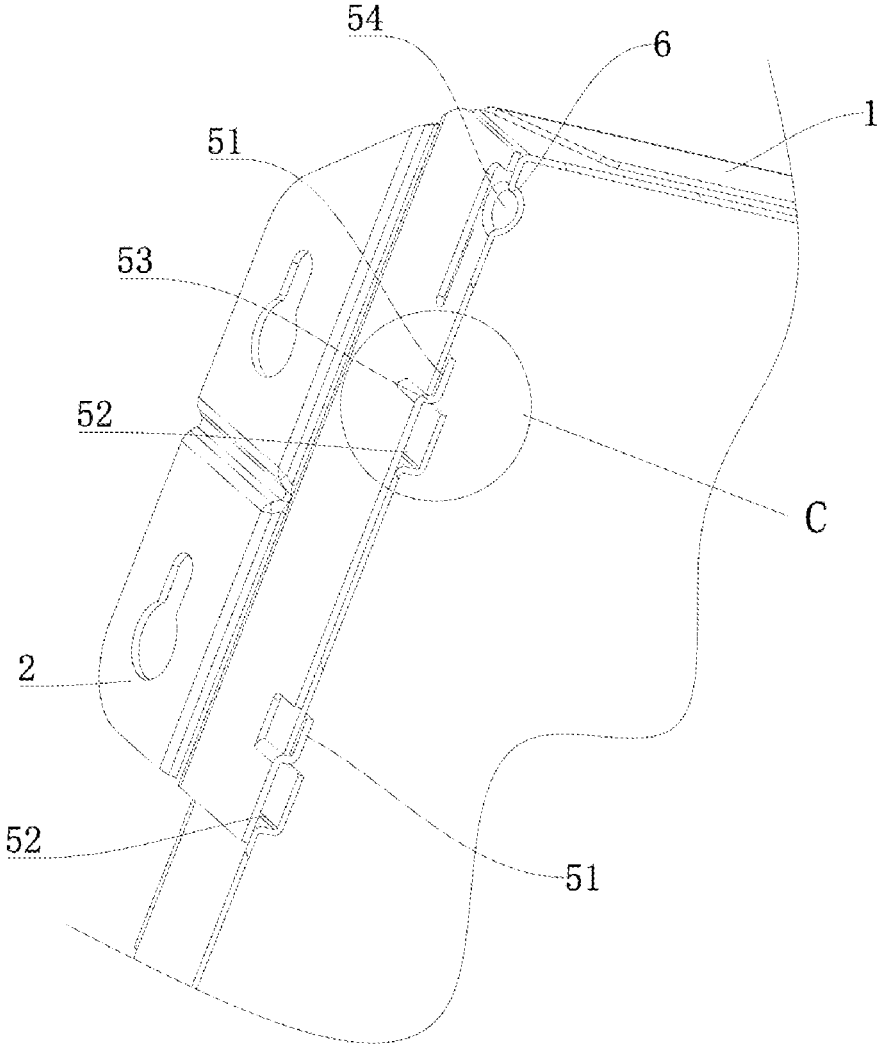
FIG. 4 illustrates an enlarged view of an expandable side unit example.

FIG. 4 shows a zoom-up view of the example of FIG. 3.

In FIG. 4, it more clearly shows the components mentioned in FIG. 3.

FIG. 5 shows another installation mode. In FIG. 5, the box housing 1 is placed on a bracket 3. The bracket 3 has an installation bar 31 and a expanding bar 32. There is a fixing unit 4. There is a bending part 43 fixed to an elongated slit 45.

FIG. 6 is a zoom-up view of the example of FIG. 5, which more clearly show the relations among components mentioned above.

Figure 7:
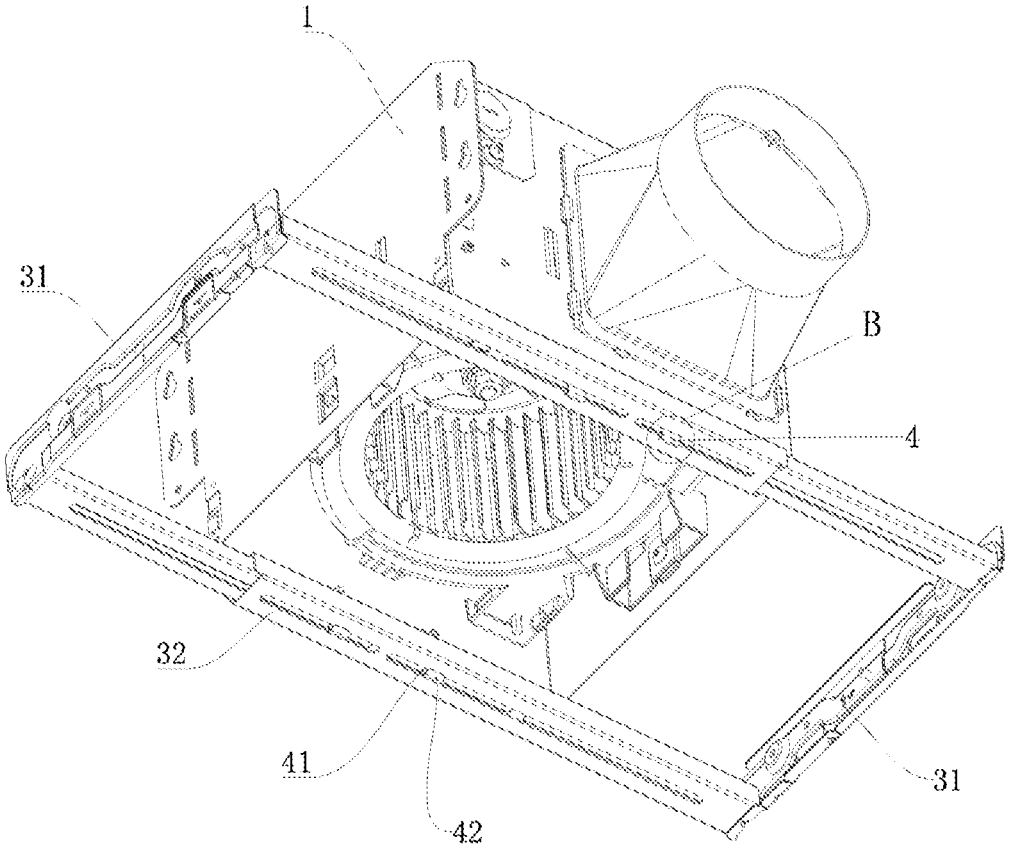
FIG. 7 illustrates another fixing unit example.

FIG. 7 shows another view of an embodiment.

Figure 8:
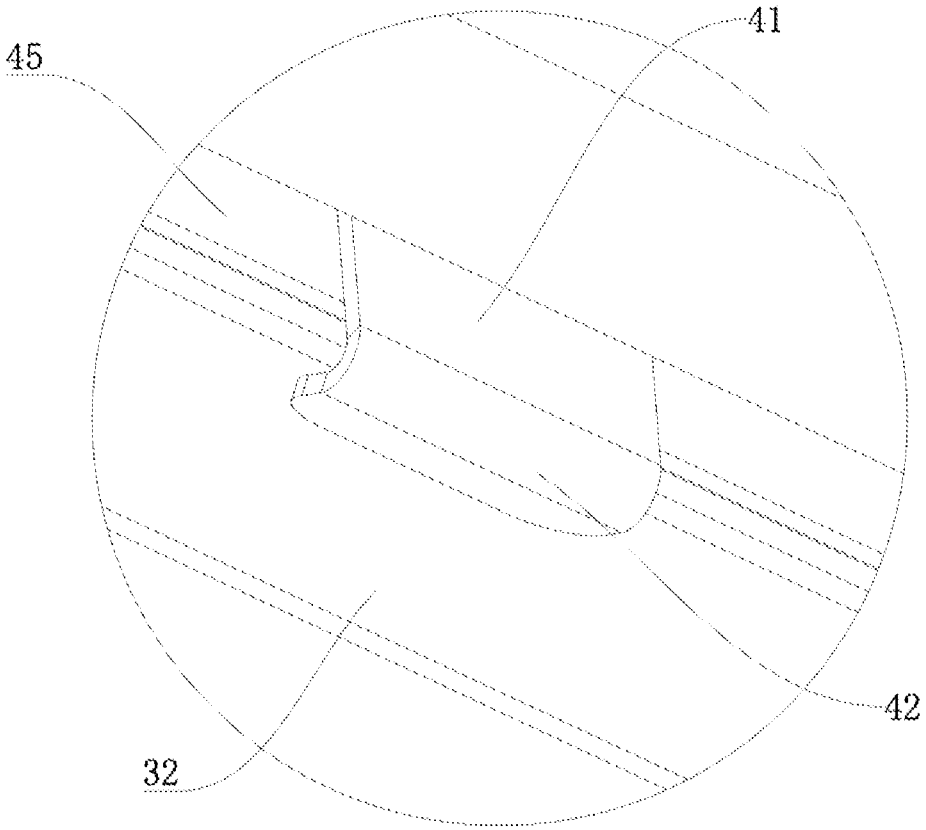
FIG. 8 illustrates a zoom-up view of the example in FIG. 7.

FIG. 8 shows the elastic hook 42 with an bending shape from a base part 41.

Figure 9:
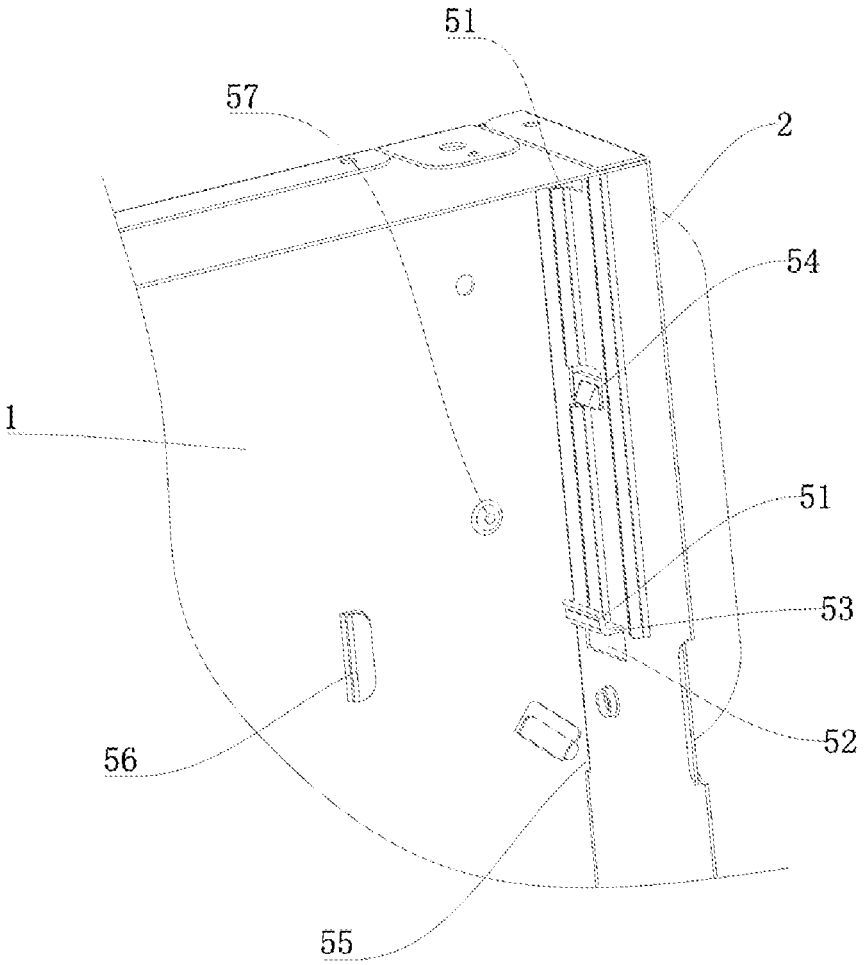
FIG. 9 illustrates installation hole examples.

FIG. 9 shows a zoom-up view of another view of an example. In addition to components mentioned above, there is a protruding structure 57 and an adjusting hole 58.

FIG. 10 shows another view of an example with components mentioned above.

Figure 11:
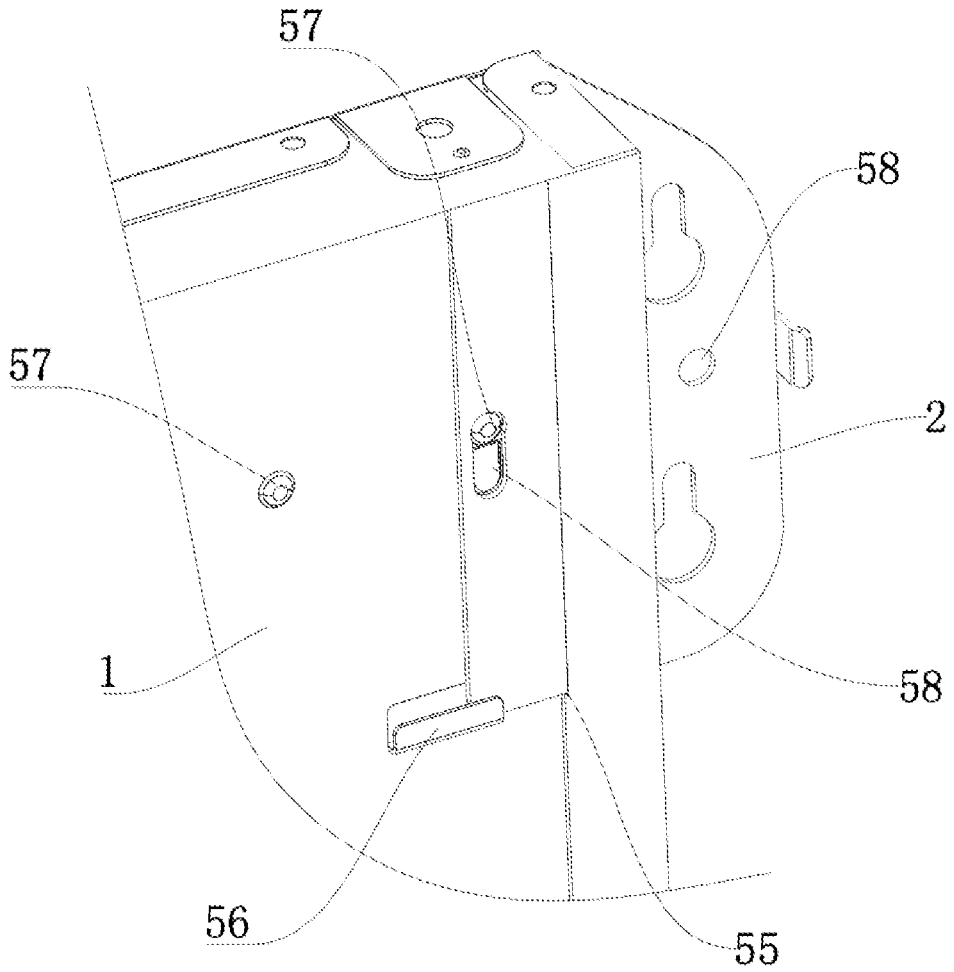
FIG. 11 illustrates connector structure example.

FIG. 11 shows another example in a zoom-up view with components mentioned above in a different manner.

Figure 12:
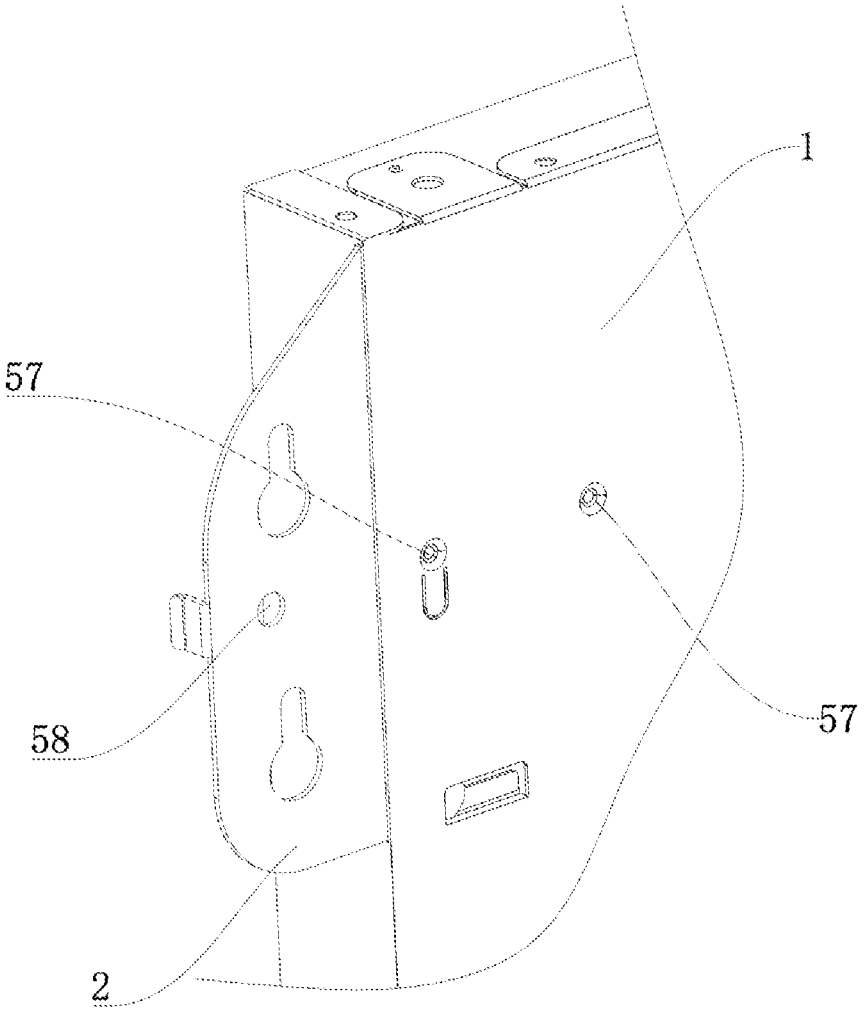
FIG. 12 illustrates an example of an expandable side unit.

FIG. 12 shows another example in a zoom-up view with components mentioned above in a different manner.

FIG. 13A shows a zoom-up view of a connection position structure in another manner.

The foregoing description, for purpose of explanation, has been described with reference to specific embodiments. However, the illustrative discussions above are not intended to be exhaustive or to limit the invention to the precise forms disclosed. Many modifications and variations are possible in view of the above teachings.

The embodiments were chosen and described in order to best explain the principles of the techniques and their practical applications. Others skilled in the art are thereby enabled to best utilize the techniques and various embodiments with various modifications as are suited to the particular use contemplated.

Although the disclosure and examples have been fully described with reference to the accompanying drawings, it is to be noted that various changes and modifications will become apparent to those skilled in the art. Such changes and modifications are to be understood as being included within the scope of the disclosure and examples as defined by the claims.

The invention claimed is:

1. An airflow apparatus, comprising:

an air tunnel;

a fan motor;

a fan blade driven by the fan motor for moving air moving in the air tunnel;

a box housing enclosing the air tunnel, the fan motor and the fan blade, wherein the box housing have multiple fixing units for fixing to a bracket when the box housing is place upon the bracket for limiting movement of the box housing in a first installation mode; and two expandable side units, wherein the two expandable side units are attached to a lateral side of the box housing, wherein the expandable side units have extending portions extending respectively from two opposite peripheral edges of the box housing, wherein there is an ear plate hole for each expandable side unit for inserting a fixing hook placed on an installation wall surface in a second installation mode.

2. The airflow apparatus of claim 1, wherein the expandable side unit comprises a geometry plate, wherein the ear plate hole is disposed on the geometry plate.

3. The airflow apparatus of claim 2, wherein the expandable side unit is detached from the box housing in the first installation mode.

4. The airflow apparatus of claim 2, wherein the expandable side unit is pushed and retracted in a storage area of the box housing in the first installation mode, wherein the expandable side unit is pulled to extend in the second installation mode.

5. The airflow apparatus of claim 2, wherein the expandable side unit is rotated to extend in the second installation mode, wherein the expandable side unit is rotated to be retracted in a storage area of the box housing in the first installation mode.

6. The airflow apparatus of claim 5, wherein the expandable side unit is fixed to the box housing with a rotation axle.

7. The airflow apparatus of claim 1, wherein the bracket has two extendable tracks, wherein the extendable track has a track slit, wherein the fixing unit passes through the track slit and bent to limit movement of the box housing with respect to the bracket.

8. The airflow apparatus of claim 7, wherein the track slit is an elongated slit with two opposite ends, wherein the fixing unit is fixed within the range of the elongated slit.

9. The airflow apparatus of claim 8, wherein the fixing unit has an elastic hook to pass through the elongated slit and fasten the fixing unit to the expandable track.

10. The airflow apparatus of claim 8, wherein the fixing unit has a bending part, wherein the bending part is bent after passing through the track slit to fasten the fixing unit to the extendable track.

11. The airflow apparatus of claim 10, wherein the bending part has a first bending portion and a second bending portion, wherein the first bending portion and the second bending portion are bent in opposite directions.

12. The airflow apparatus of claim 7, further comprising the bracket, wherein the expandable track has a track part and a bar part, where the bar part is retracted partly in the track part to change a length of the expandable track.

13. The airflow apparatus of claim 12, wherein the track parts of the two extendable tracks are connected to opposite sides of the bracket.

14. The airflow apparatus of claim 1, wherein a first air vent of the box housing faces downwardly to the bracket.

15. The airflow apparatus of claim 14, wherein a second air vent of the box housing is disposed to another lateral side, wherein the air tunnel connects the first air vent to the second air vent.

16. The airflow apparatus of claim 1, further comprising an ultraviolet light source for sterilization, wherein the ultraviolet light source is placed in the air tunnel and concealed by the box housing.

17. The airflow apparatus of claim 16, further comprising a illumination light source, wherein the illumination light source emit light escaping from the first air vent.

18. The airflow apparatus of claim 17, wherein the box housing has a light bracket for attaching the illumination light source, wherein the first air vent is a gap aside the light bracket.

19. The airflow apparatus of claim 18, wherein the illumination light source is detachable from the light bracket.

20. The airflow apparatus of claim 1, wherein the bracket further has two side bars for connecting the two extendable tracks forming a rectangular shape, wherein the two side bars are fixed on two opposite walls.

* * * * *